US008605001B2

(12) United States Patent
Yamamoto et al.

(10) Patent No.: US 8,605,001 B2
(45) Date of Patent: Dec. 10, 2013

(54) RADOME EQUIPMENT

(75) Inventors: Shinichi Yamamoto, Tokyo (JP); Shuji Nuimura, Tokyo (JP); Izuru Naito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 160 days.

(21) Appl. No.: 13/381,200

(22) PCT Filed: Sep. 1, 2010

(86) PCT No.: PCT/JP2010/064931

§ 371 (c)(1),
(2), (4) Date: Dec. 28, 2011

(87) PCT Pub. No.: WO2011/033935

PCT Pub. Date: Mar. 24, 2011

(65) Prior Publication Data

US 2012/0127057 A1 May 24, 2012

(30) Foreign Application Priority Data

Sep. 17, 2009 (JP) ..... 2009-215995

(51) Int. Cl.
*H01Q 1/42* (2006.01)

(52) U.S. Cl.
USPC ..... 343/872

(58) Field of Classification Search
USPC ..... 343/872, 873
See application file for complete search history.

(56) References Cited

U.S. PATENT DOCUMENTS 2,854,668 A * 9/1958 McMillan et al. ..... 343/872
3,633,206 A * 1/1972 McMillan ..... 343/754
4,148,039 A 4/1979 Lunden
4,358,772 A * 11/1982 Leggett ..... 343/872
5,017,939 A * 5/1991 Wu ..... 343/911 R
5,408,244 A * 4/1995 Mackenzie ..... 343/872
7,420,523 B1 9/2008 Ziolkowski et al.

FOREIGN PATENT DOCUMENTS

| | | |
|---|---|---|
| JP | 47 24254 | 10/1972 |
| JP | 54 107655 | 8/1979 |
| JP | 3 119807 | 5/1991 |
| JP | 6 196915 | 7/1994 |
| JP | 2001-127523 | 5/2001 |
| JP | 2004 88185 | 3/2004 |
| JP | 2005-033475 | 2/2005 |

OTHER PUBLICATIONS

International Search Report Issued Dec. 7, 2010 in PCT/JP10/64931 Filed Sep. 1, 2010.
U.S. Appl. No. 13/382,031, filed Jan. 3, 2012, Yamamoto, et al.
Office Action/Preliminary Notice of Reasons for Rejection mailed, Jun. 25, 2013, in Japanese Application No. 2011-531878 (with English Translation).

* cited by examiner

*Primary Examiner* — Tho G Phan
(74) *Attorney, Agent, or Firm* — Oblon, Spivak, McClelland, Maier & Neustadt, L.L.P.

(57) ABSTRACT

Radome equipment that includes an antenna device, and a radome that protects the antenna device by housing the antenna device therein and that transmits electric power necessary for communication, in which: a matching layer made of a single-layer dielectric is attached to an inner surface of the radome; and the matching layer has a thickness that is set to a value that minimizes reflection based on an impedance estimated from an interface between the matching layer and the radome before the matching layer of the radome is attached, a characteristic impedance of a medium of the matching layer, a wavelength in the matching layer, and a characteristic impedance of a medium of a space in which the radome is disposed.

5 Claims, 6 Drawing Sheets

RADOME EQUIPMENT

TECHNICAL FIELD

The present invention relates to a radome equipment that is required to protect an antenna and to transmit communication electric power.

BACKGROUND ART

Conventionally, as to this type of radome equipment, for example, there is disclosed a method of suppressing reflection by a radome using a matching layer having a relative dielectric constant that is ½ power of a relative dielectric constant of the radome and a thickness of ¼ wavelength (see, for example, Patent Literature 1). In addition, there is a document disclosing a matching layer of a lens in the same manner as described above (see, for example, Patent Literature 2). Patent Literature 1 discloses that powder of a material having a small tan δ is added to urethane foam or the like in order to obtain a dielectric constant of the matching layer. In addition, Patent Literature 2 discloses that a desired dielectric constant is obtained in an equivalent manner by grooves on the surface of the lens.

CITATION LIST

Patent Literature

[PTL 1] JP 2004-200895 A
[PTL 2] JP 11-355035 A

SUMMARY OF INVENTION

Technical Problem

In the conventional radome equipment, it is necessary to use the matching layer material having a relative dielectric constant that is ½ power of a relative dielectric constant of the radome itself in order to suppress reflection by the radome. Therefore, in order to obtain a desired relative dielectric constant, a foam material is used to change a foam ratio, another material is mixed, or holes or grooves are formed. It is considered that materials that can be used for the matching layer are limited in view of weight, mechanical strength, productivity, cost, and the like. Therefore, there is a case where a material having a desired dielectric constant cannot be obtained.

The present invention has been made to solve the above-mentioned problem, and an object thereof is to provide a radome equipment that is capable of minimizing reflection by a radome by changing a thickness of a matching layer when a material of the matching layer is fixed.

Solution to Problem

A radome equipment according to the present invention includes an antenna device, and a radome that protects the antenna device from an operating environment by housing the antenna device therein and that transmits electric power necessary for communication, in which: a matching layer made of a single-layer dielectric is attached to an inner surface of the radome; and the matching layer has a thickness that is set to a value that minimizes reflection based on an impedance estimated from an interface between the matching layer and the radome before the matching layer of the radome is attached, a characteristic impedance of a medium of the matching layer, a wavelength in the matching layer, and a characteristic impedance of a medium of a space in which the radome is disposed.

Advantageous Effects of Invention

According to the present invention, even if a material that can be used for the matching layer is limited and a dielectric constant of the matching layer is fixed, reflection by the radome can be minimized by setting the thickness of the matching layer to an optimal value based on the impedance estimated from the interface between the matching layer and the radome before the matching layer of the radome is attached, the characteristic impedance of the medium of the matching layer, the wavelength in the matching layer, and the characteristic impedance of the medium of the space in which the radome is disposed.

DESCRIPTION OF EMBODIMENTS

Embodiment 1

Figure 1:
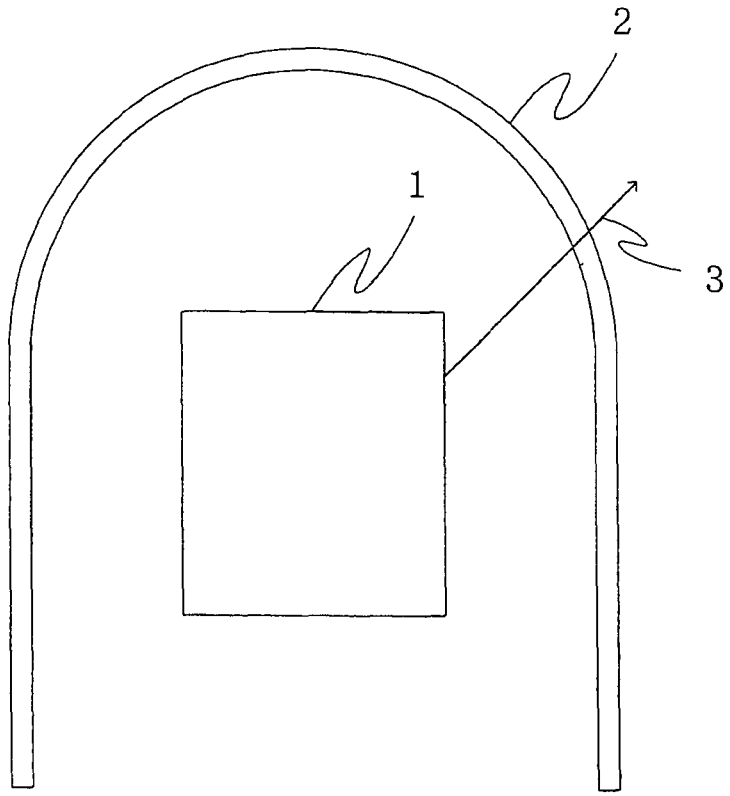
FIG. 1 A structural diagram of a radome equipment according to Embodiment 1 of the present invention.
Figure 2:
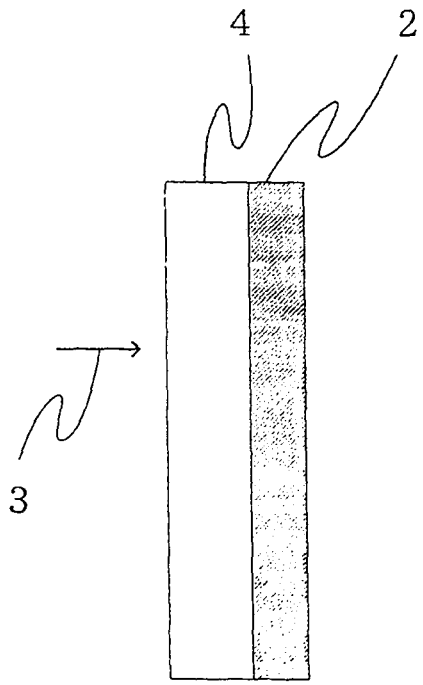
FIG. 2 A diagram in which a part of a radome illustrated in FIG. 1 is extracted.

FIG. 1 is a structural diagram of a radome equipment according to Embodiment 1 of the present invention. In addition, FIG. 2 is a diagram in which a part of a radome is extracted, and matching with respect to orthogonal incidence to a dielectric flat plate is considered. As illustrated in FIGS. 1 and 2, the radome equipment includes an antenna device 1, and a radome 2 that protects the antenna device 1 from an operating environment by housing the antenna device therein and that transmits electric power necessary for communication. A matching layer 4 made of a single-layer dielectric is attached to the inner surface of the radome 2. Note that, a propagation direction of a radio wave is denoted by 3 in FIGS. 1 and 2.

By attaching the matching layer 4 to the radome 2, reflection characteristic is improved. When a relative dielectric constant of the radome 2 is denoted by $\in_r$, reflection by the radome 2 is suppressed by disposing the matching layer 4 having a thickness of λ/4 and a relative dielectric constant $\in_m=\sqrt{\in_r}$. In order to obtain a material having a specified dielectric constant, a foam material is used to change a foam ratio, different materials are mixed, or holes are formed in the dielectric so that the dielectric constant is adjusted in an equivalent manner. According to the present invention, even if a material that can be used for the matching layer 4 is limited and the dielectric constant $\in_m$ of the matching layer 4 is fixed, reflection by the radome 2 can be minimized by setting a thickness of the matching layer 4 to an optimal value based on an impedance estimated from an interface between the matching layer 4 and the radome 2 before the matching layer 4 of the radome 2 is attached, a characteristic impedance of a medium of the matching layer 4, a wavelength in the matching layer 4, and a characteristic impedance of a medium of a space in which the radome 2 is disposed.

Embodiment 2

Figure 3:
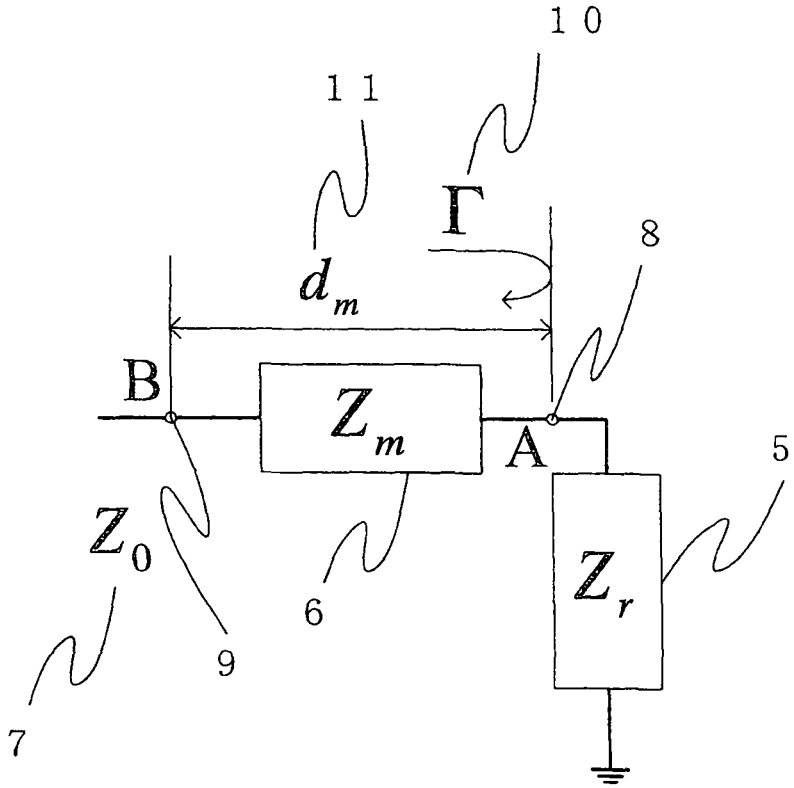
FIG. 3 A diagram illustrating an equivalent circuit of the radome illustrated in FIG. 2, according to Embodiments 2 and 3 of the present invention.

FIG. 3 is a diagram illustrating an equivalent circuit of the radome 2 illustrated in FIG. 2. Here, an impedance estimated from an interface between the matching layer 4 and the radome 2 before the matching layer 4 is attached is denoted by $Z_r$, and a characteristic impedance of a medium of the matching layer 4 is denoted by $Z_m$. The impedance of the medium of the space into which a radio wave enters can be regarded to be a wave impedance $Z_0$ of the free space considering a case where the radome 2 is in the air, and is expressed by the following expression.

[Math. 1]

$$Z_0 = \sqrt{\frac{\mu_0}{\varepsilon_0}} \approx 120\pi[\Omega] \tag{1}$$

In this expression, $\mu_0$ denotes a magnetic permeability of the free space, and $\in_0$ denotes a dielectric constant of the free space. Supposing that the matching layer 4 is made of a single-layer dielectric without a loss and that the relative dielectric constant thereof is denoted by $\in_m$, then the impedance $Z_m$ of the matching layer 4 is expressed by the following expression.

[Math. 2]

$$Z_m = \sqrt{\frac{\mu_0}{\varepsilon_m \varepsilon_0}} = \frac{Z_0}{\sqrt{\varepsilon_m}} \tag{2}$$

Figure 4:
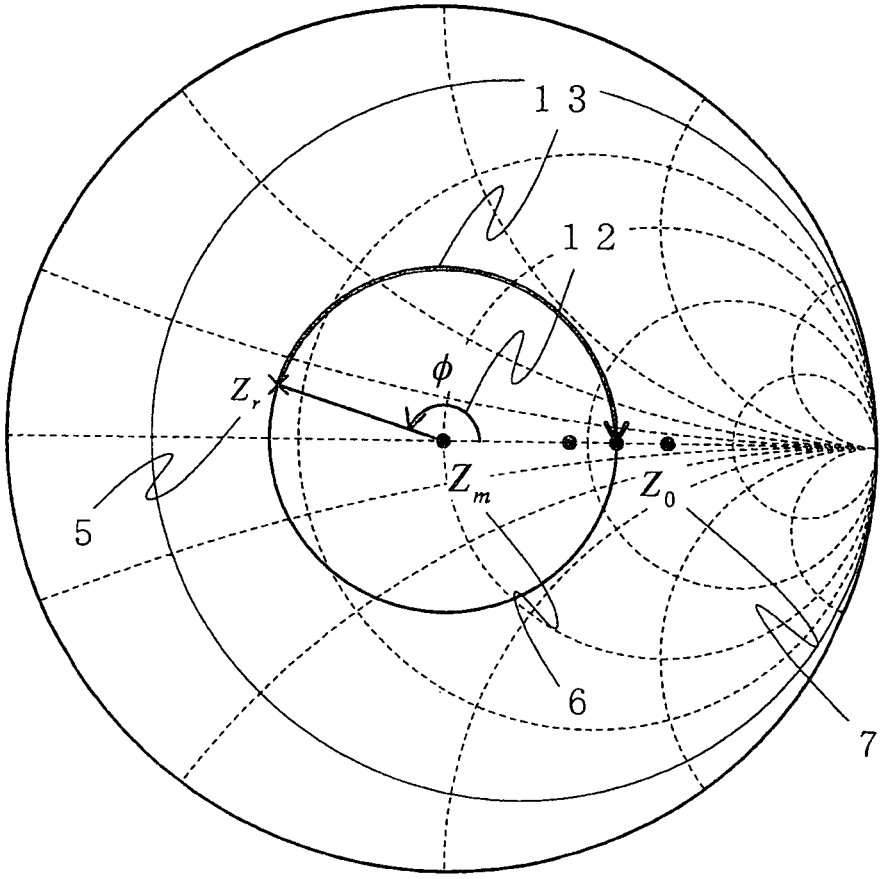
FIG. 4 A Smith chart illustrating a relationship among impedances of the radome.

Here, when the relative dielectric constant $\in_m$ of the matching layer 4, namely the characteristic impedance $Z_m$ of the matching layer 4 is given, a thickness $d_m$ of the matching layer 4 that minimizes the reflection is considered. A relationship among impedances of the radome 2 is illustrated in a Smith chart of FIG. 4. In FIG. 4, impedances are normalized by the characteristic impedance $Z_m$ of the matching layer 4 and are illustrated in which the center is $Z_m$. The impedance $Z_r$ of the radome 2 obtained before the matching layer 4 is attached contains an influence of reflection by the radome outer wall, a radome loss, and the like, and hence is a complex number in general. Here, a real part $Z_r^R$ and an imaginary part $Z_r^I$ of $Z_r$ are respectively expressed by the following expressions.

$$Z_r^R \equiv Re[Z_r] \quad \text{[Math. 3]}$$

$$Z_r^I \equiv Im[Z_r] \quad \text{[Math. 4]}$$

The impedance $Z_r$ of the radome 2 is plotted on the Smith chart of FIG. 4.

As a thickness of the matching layer 4 increases, the reflection at a point B in the equivalent circuit of FIG. 3 moves to rotate counterclockwise on a circle having the center $Z_m$ in FIG. 4 and a radius of a reflection coefficient Γ viewed from a point A toward the termination. The reflection viewed from the point B is minimized at the thickness $d_m$ corresponding to a point closest to an air characteristic impedance $Z_0$ on the Smith chart of FIG. 4.

The air characteristic impedance $Z_0$ is a real number, and the relative dielectric constant $\in_m$ of a dielectric is generally larger than one (1). Therefore, $Z_m<Z_0$ is satisfied, and $Z_0$ is plotted on the real axis on the high impedance side (right side) of the center in the Smith chart of FIG. 4.

The reflection is minimized at an intersection of the circle and the real axis on the positive side. In this case, depending on a magnitude relationship among values of $Z_r$, $Z_m$, and $Z_0$, there are a case where $Z_0$ is plotted outside the circle and a case where $Z_0$ is plotted inside the circle. If $Z_0$ is plotted at the intersection of the circle and the real axis, the reflection viewed from the point B becomes zero. In other words, complete matching is obtained.

The reflection coefficient Γ of the radome 2 viewed from the point A toward the termination in the equivalent circuit of FIG. 3 is expressed by the following expression.

[Math. 5]

$$\Gamma = \frac{Z_r - Z_m}{Z_r + Z_m} \tag{3}$$

This phase ϕ corresponds to a rotation angle in the Smith chart.

The expression (3) is modified as follows.

[Math. 6]

$$\begin{aligned}\Gamma &= \frac{Z_r - Z_m}{Z_r + Z_m} \\ &= \frac{Z_r^R - Z_m + jZ_r^I}{Z_r^R + Z_m + jZ_r^I} \\ &= \frac{(Z_r^R - Z_m)(Z_r^R + Z_m) + (Z_r^I)^2 + j2Z_mZ_r^I}{(Z_r^R + Z_m)^2 + (Z_r^I)^2}\end{aligned} \tag{4}$$

The reflection phase ϕ is expressed by the following expression.

[Math. 7]

$$\begin{aligned}\phi &= \tan^{-1}\frac{2Z_mZ_r^I}{(Z_r^R - Z_m)(Z_r^R + Z_m) + (Z_r^I)^2} \\ &= \tan^{-1}\frac{2Z_mZ_r^I}{(Z_r^R)^2 + (Z_r^I)^2 - Z_m^2} \\ &= \tan^{-1}\frac{2Z_m\mathrm{Im}[Z_r]}{|Z_r|^2 - Z_m^2}\end{aligned} \tag{5}$$

Here, it is supposed that $0 \le \tan^{-1}X < 2\pi$ is satisfied. In other words, $0 \le \phi \le \pi$ is satisfied if $\mathrm{Im}[\Gamma] \ge 0$ (or $\mathrm{Im}[Z_r] \ge 0$) holds, and $\pi < \phi < 2\pi$ is satisfied if $\mathrm{Im}[\Gamma] < 0$ (or $\mathrm{Im}[Z_r] < 0$) holds. If $\mathrm{Im}[Z_r]=0$ holds (If $Z_r$ is a real number), as is clear from the expression (4), $\Gamma<0$ and $\phi=\pi$ are satisfied when $Z_r<Z_m$ holds, while $\Gamma>0$ and $\phi=0$ are satisfied when $Z_r>Z_m$ holds. In general, for the matching layer 4, it is common to use a material having a lower dielectric constant than that of the original radome 2, and hence $|Z_r|<Z_m$ is usually satisfied.

Because one circle in the Smith chart corresponds to λ/2, the optimal thickness $d_m$ of the matching layer 4 is expressed by the following expression.

[Math. 8]

$$d_m = \frac{\phi}{2\pi}\frac{\lambda}{2} = \frac{\lambda}{4\pi}\tan^{-1}\frac{2Z_m\mathrm{Im}[Z_r]}{|Z_r|^2 - Z_m^2} \quad (6)$$

In this expression, $\lambda$ denotes a wavelength in the matching layer 4. When the free space wavelength is denoted by $\lambda_0$, $\lambda=\lambda_0/\sqrt{\in_m}$ is satisfied.

Note that, the matching layer 4 having the thickness determined by the expression (6) is not generally a complete matching layer with no reflection by the radome 2, but can improve the reflection by the radome 2. In addition, the expression (5) indicates a center value of the thickness of the matching layer 4, and there is an effect of reducing the reflection even if the dielectric constant or the thickness of the matching layer 4 varies a little. Further, the effect can be obtained also in a case where the dielectric constant or the thickness of the radome 2 itself is varied before the matching layer 4 is attached. The dielectric constant of the matching layer 4 is generally set to be lower than the dielectric constant of the radome 2. In this case, an influence of variation in the dielectric constant, in the thickness, or in a frequency can be reduced in particular.

Embodiment 3

Because one circle in the Smith chart corresponds to $\lambda/2$, the reflection can be suppressed in the same manner even by adding an integral multiple of a half wavelength to the thickness described above in Embodiment 2. Therefore, the optimal thickness $d_m$ of the matching layer 4 is expressed by the following expression.

[Math. 9]

$$d_m = \frac{\phi}{2\pi}\frac{\lambda}{2} + n\frac{\lambda}{2} = \frac{\lambda}{4\pi}\tan^{-1}\frac{2Z_m\mathrm{Im}[Z_r]}{|Z_r|^2 - Z_m^2} + n\frac{\lambda}{2} \quad (7)$$

In this expression, n denotes an integer of one (1) or larger. If n is zero, this expression is the same as the expression (6).

When the thickness of the radome itself or the matching layer 4 determined by the expression (6) is small, it is possible to enhance the mechanical strength by adding an integral multiple of a half wavelength.

Embodiment 4

In general, if the radome 2 is in the air, the characteristic impedance $Z_m$ of the matching layer 4 is smaller than the air characteristic impedance $Z_0$ ($Z_m<Z_0$), because the dielectric constant of the matching layer 4 is larger than the air dielectric constant $\in_0$. However, if the radome 2 is in a medium, for example, in water, $Z_0$ may exist on the low impedance side of $Z_m$.

Figure 5:
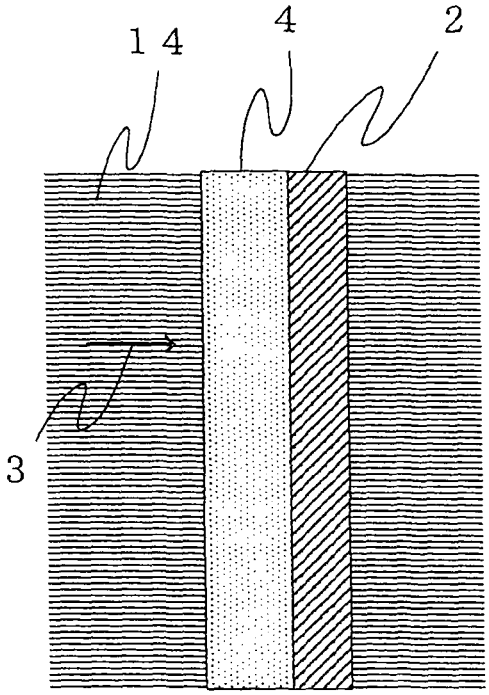
FIG. 5 A diagram illustrating a radome in a medium, according to Embodiments 4 and 5 of the present invention.
Figure 6:
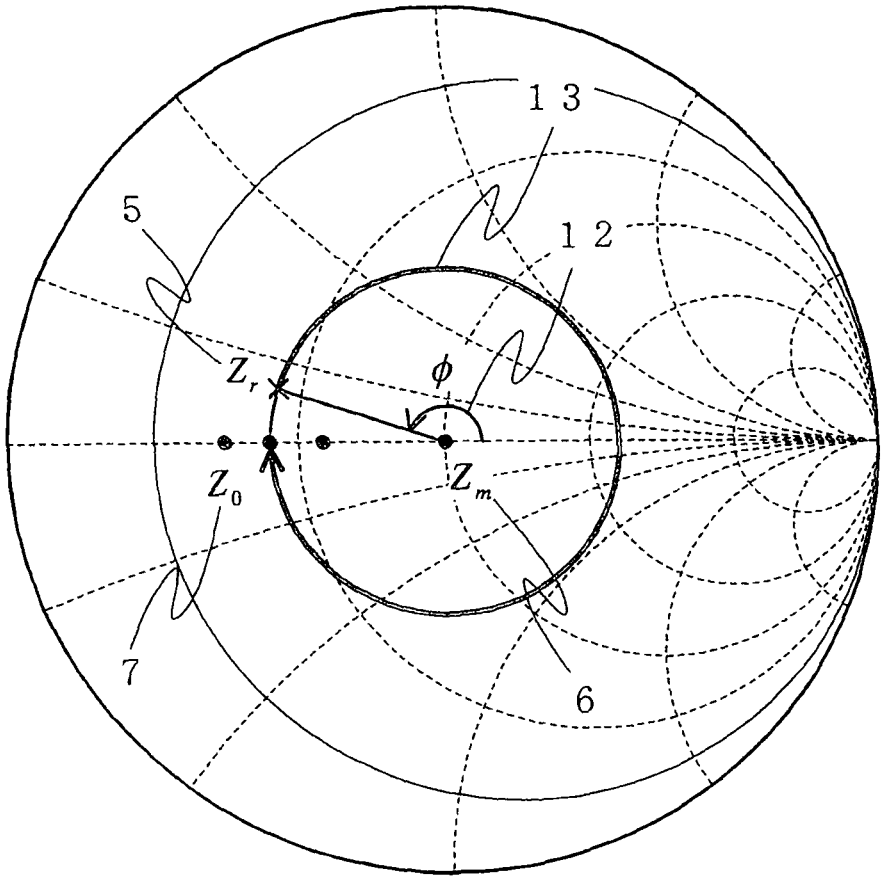
FIG. 6 A Smith chart corresponding to FIG. 5.

FIG. 5 illustrates a state in which the radome 2 is in a medium 14, and FIG. 6 illustrates a Smith chart corresponding to FIG. 5. The equivalent circuit corresponding to FIG. 3 is obtained by replacing the characteristic impedance $Z_0$ with a characteristic impedance Z of the medium in which the radome 2 is placed. As a matter of course, if $Z_m$ is a lower impedance even in the medium, the Smith chart is the same as illustrated in FIG. 4.

If $Z_m<Z_0$ holds, the reflection is minimized at the intersection of the circle and the real axis on the positive side. If $Z_m>Z_0$ holds, the reflection is minimized at the intersection of the circle and the real axis on the negative side. Note that, if $Z_m=Z_0$ holds, it is the same as the state in which nothing is loaded electrically. In this case, the reflection coefficient is not changed even if the thickness of the matching layer 4 is changed. The reflection characteristic cannot be improved by such matching layer 4. Depending on a magnitude relationship among values of $Z_r$, $Z_m$, and $Z_0$, there are a case where $Z_0$ is plotted outside the circle and a case where $Z_0$ is plotted inside the circle. If $Z_0$ is plotted at the intersection of the circle and the real axis, the reflection viewed from the point B becomes zero. In other words, complete matching is obtained.

In the Smith charts illustrated in FIGS. 4 and 6, the optimal points at which the reflection is minimized are different from each other by a half cycle ($\lambda/4$). Therefore, the optimal thickness $d_m$ of the matching layer 4 is expressed by the following expression.

[Math. 10]

$$d_m = \frac{\phi}{2\pi}\frac{\lambda}{2} + \frac{\lambda}{4} = \frac{\lambda}{4\pi}\tan^{-1}\frac{2Z_m\mathrm{Im}[Z_r]}{|Z_r|^2 - Z_m^2} + \frac{\lambda}{4} \quad (8)$$

In this expression, $\lambda$ denotes the wavelength in the matching layer 4. When the free space wavelength is denoted by $\lambda_0$, $\lambda=\lambda_0/\sqrt{\in_m}$ is satisfied.

Note that, the matching layer 4 having the thickness determined by the expression (8) is not generally a complete matching layer with no reflection by the radome 2, but can improve the reflection by the radome 2. In addition, the expression (5) indicates a center value of the thickness of the matching layer 4, and there is an effect of reducing the reflection even if the dielectric constant or the thickness of the matching layer 4 varies a little. Further, the effect can be obtained also in a case where the dielectric constant or the thickness of the radome 2 itself is varied before the matching layer 4 is attached. The dielectric constant of the matching layer 4 is generally set to be lower than the dielectric constant of the radome 2. In this case, an influence of variation in the dielectric constant, in the thickness, or in the frequency can be reduced in particular.

Embodiment 5

Because one circle in the Smith chart corresponds to $\lambda/2$, the reflection can be suppressed in the same manner even by adding an integral multiple of a half wavelength to the thickness described above in Embodiment 4. Therefore, the optimal thickness $d_m$ of the matching layer 4 is expressed by the following expression.

[Math. 11]

$$d_m = \frac{\phi}{2\pi}\frac{\lambda}{2} + (2n-1)\frac{\lambda}{4} = \frac{\lambda}{4\pi}\tan^{-1}\frac{2Z_m\mathrm{Im}[Z_r]}{|Z_r|^2 - Z_m^2} + (2n-1)\frac{\lambda}{2} \quad (9)$$

In this expression, n denotes an integer of zero or larger except one (1) if $\mathrm{Im}[Z_r]<0$ holds, while n denotes an integer of two (2) or larger if $\mathrm{Im}[Z_r]\geq 0$ holds (If $\mathrm{Im}[Z_r]\geq 0$ and n=0 hold, $d_m$ becomes negative.). If n is one (1), this expression is the same as the expression (8).

When the thickness of the radome itself or the matching layer 4 determined by the expression (8) is small, it is possible to enhance the mechanical strength by adding an integral multiple of a half wavelength. If $Im[Z_r]<0$ holds, the thickness of the matching layer 4 can be smaller than that in Embodiment 3.

REFERENCE SIGNS LIST

1 antenna device, 2 radome, 3 propagation direction of radio wave, 4 matching layer, 14 medium

The invention claimed is:

1. A radome equipment comprising an antenna device, and a radome that protects the antenna device from an operating environment by housing the antenna device therein and that transmits electric power necessary for communication, wherein:

a matching layer made of a single-layer dielectric is attached to an inner surface of the radome; and a thickness of the matching layer is set to a value that minimizes reflection based on an impedance estimated from an interface between the matching layer and the radome before the matching layer of the radome is attached, a characteristic impedance of a medium of the matching layer, a wavelength in the matching layer, and a characteristic impedance of a medium of a space in which the radome is disposed.

2. A radome equipment according to claim 1, wherein when, defining that $Z_r$ denotes the impedance estimated from the interface between the matching layer and the radome before the radome matching layer is attached, $Z_m$ denotes the characteristic impedance of the matching layer medium, $\lambda$ denotes the wavelength in the matching layer, and $Z_0$ denotes the characteristic impedance of the medium of the space in which the radome is disposed, $Z_m<Z_0$ is established, a thickness $d_m$ of the matching layer is expressed by the following expression,

[Math. 1]

$$d_m = \frac{\lambda}{4\pi}\tan^{-1}\frac{2Z_m\mathrm{Im}(Z_r)}{|Z_r|^2 - Z_m^2}$$

provided that $0\leq\tan^{-1}X\leq\pi$ is established when $Im[Z_r]\geq 0$ holds, while $\pi<\tan^{-1}X\leq 2\pi$ is established when $Im[Z_r]<0$ holds.

3. A radome equipment according to claim 1, wherein when, defining that $Z_r$ denotes the impedance estimated from the interface between the matching layer and the radome before the radome matching layer is attached, $Z_m$ denotes the characteristic impedance of the matching layer medium, $\lambda$ denotes the wavelength in the matching layer, and $Z_0$ denotes the characteristic impedance of the medium of the space in which the radome is disposed, $Z_m<Z_0$ is established, a thickness $d_m$ of the matching layer is expressed by the following expression,

[Math. 2]

$$d_m = \frac{\lambda}{4\pi}\tan^{-1}\frac{2Z_m\mathrm{Im}(Z_r)}{|Z_r|^2 - Z_m^2} + n\frac{\lambda}{2}$$

provided that n denotes an integer of one (1) or larger.

4. A radome equipment according to claim 1, wherein when, defining that $Z_r$ denotes the impedance estimated from the interface between the matching layer and the radome before the radome matching layer is attached, $Z_m$ denotes the characteristic impedance of the matching layer medium, $\lambda$ denotes the wavelength in the matching layer, and $Z_0$ denotes the characteristic impedance of the medium of the space in which the radome is disposed, $Z_m<Z_0$ is established, a thickness $d_m$ of the matching layer is expressed by the following expression,

[Math. 3]

$$d_m = \frac{\lambda}{4\pi}\tan^{-1}\frac{2Z_m\mathrm{Im}(Z_r)}{|Z_r|^2 - Z_m^2} + \frac{\lambda}{4}.$$

5. A radome equipment according to claim 1, wherein when, defining that $Z_r$ denotes the impedance estimated from the interface between the matching layer and the radome before the radome matching layer is attached, $Z_m$ denotes the characteristic impedance of the matching layer medium, $\lambda$ denotes the wavelength in the matching layer, and $Z_0$ denotes the characteristic impedance of the medium of the space in which the radome is disposed, $Z_m<Z_0$ is established, a thickness $d_m$ of the matching layer is expressed by the following expression,

[Math. 4]

$$d_m = \frac{\lambda}{4\pi}\tan^{-1}\frac{2Z_m\mathrm{Im}(Z_r)}{|Z_r|^2 - Z_m^2} + (2n-1)\frac{\lambda}{4}$$

provided that n denotes an integer of zero or larger except one (1) when $Im[Z_r]<0$ holds, while n denotes an integer of two (2) or larger when $Im[Z_r]\geq 0$ holds.

* * * * *